US010035076B2

(12) United States Patent
Yu

(10) Patent No.: US 10,035,076 B2
(45) Date of Patent: Jul. 31, 2018

(54) TRANSFORMER TOY WITH ROLLING VEHICLE INTEGRATED INTO COMMAND CENTER

(71) Applicant: MGA Entertainment, Inc., Van Nuys, CA (US)

(72) Inventor: Glenn Nai-Tong Yu, El Segundo, CA (US)

(73) Assignee: MGA Entertainment, Inc., Van Nuys, CA (US)

( * ) Notice: Subject to any disclaimer, the term of this patent is extended or adjusted under 35 U.S.C. 154(b) by 0 days.

(21) Appl. No.: 15/692,835

(22) Filed: Aug. 31, 2017

(65) Prior Publication Data

US 2018/0078870 A1 Mar. 22, 2018

Related U.S. Application Data

(60) Provisional application No. 62/397,820, filed on Sep. 21, 2016.

(51) Int. Cl.

| | |
|---|---|
| ***A63H 17/02*** | (2006.01) |
| ***A63H 33/00*** | (2006.01) |
| ***A63H 17/26*** | (2006.01) |
| ***A63H 17/00*** | (2006.01) |

(52) U.S. Cl.

CPC ..... *A63H 33/003* (2013.01); *A63H 17/004* (2013.01); *A63H 17/02* (2013.01); *A63H 17/262* (2013.01)

(58) Field of Classification Search

CPC ..... A63H 3/00; A63H 17/00; A63H 17/004; A63H 17/02; A63H 27/00; A63H 33/003

See application file for complete search history.

(56) References Cited

U.S. PATENT DOCUMENTS

| | | | | |
|---|---|---|---|---|
| 4,516,948 | A * | 5/1985 | Obara | A63H 33/003 446/376 |
| 4,626,223 | A * | 12/1986 | Sweet | A63H 17/004 446/279 |
| 5,310,378 | A | 5/1994 | Shannon | |
| 6,520,829 | B1 * | 2/2003 | Temple | A63H 17/05 446/434 |
| 7,217,170 | B2 | 5/2007 | Moll et al. | |
| 7,467,986 | B2 | 12/2008 | Hanamoto et al. | |
| 7,785,168 | B2 | 8/2010 | Yamada et al. | |

(Continued)

FOREIGN PATENT DOCUMENTS

| | | |
|---|---|---|
| GB | 2164263 A | 3/1986 |
| KR | 100425921 B1 | 3/2004 |

OTHER PUBLICATIONS

Bakugon, Ltd., still shots of video posted at www.bakugon.com, retreived from Internet Jun. 23, 2017. See accompanying Information Disclosure Statement for description and transcript.

*Primary Examiner* — John Ricci

(74) *Attorney, Agent, or Firm* — Intellectual Property Law Offices of Joel Voelzke, APC

(57) ABSTRACT

A transformer toy in a first and untransformed configuration receives a toy vehicle therein. The vehicle entering the first toy triggers the toy to transform into a robot, airplane, or other figure or structure capable of movement. As the toy transforms, it picks up the vehicle and positions it within the cockpit or other command center of the transformed toy such that a driver of the vehicle now appears to be commanding the transformed toy.

21 Claims, 7 Drawing Sheets

(56) References Cited

U.S. PATENT DOCUMENTS

| | | | | |
|---|---|---|---|---|
| 7,794,300 | B2 | 9/2010 | Moll et al. | |
| 8,348,715 | B2 * | 1/2013 | Miyake | A63H 33/003 446/321 |
| 8,814,629 | B2 | 8/2014 | Johnston et al. | |
| 9,308,461 | B2 | 4/2016 | Yamada et al. | |
| 9,370,725 | B2 | 6/2016 | Choi | |
| 2006/0270319 | A1 * | 11/2006 | Campbell | A63H 17/02 446/431 |
| 2006/0270321 | A1 * | 11/2006 | Benedict | A63H 17/02 446/465 |
| 2014/0051325 | A1 * | 2/2014 | Paukert | A63H 33/003 446/297 |
| 2015/0196850 | A1 * | 7/2015 | Kobayashi | A63H 33/003 446/376 |
| 2016/0045835 | A1 | 2/2016 | Choi | |
| 2017/0274292 | A1 * | 9/2017 | Kanai | A63H 33/003 |

* cited by examiner

8

TRANSFORMER TOY WITH ROLLING VEHICLE INTEGRATED INTO COMMAND CENTER

CROSS-REFERENCE TO RELATED APPLICATIONS

This application claims benefit of U.S. provisional patent application No. 62/397,820 filed Sep. 21, 2016.

BACKGROUND OF THE INVENTION

1. Field of the Invention

This invention relates to the field of transforming toys. More particularly, this invention relates to the field a transforming toy that integrates into its command center a vehicle that rolls into the toy.

2. Description of Related Art

Various transforming toys exist. Commonly, the transforming toy consists of a vehicle or other relatively simple toy that, when triggered, unfolds via spring action and transforms into a humanoid or robotic form, or other toy that is more complex than when the toy is in its untriggered state. Typical triggering mechanisms include magnetic switches and physical switches.

GB2164263(A) by Asahi Corporation discloses a toy vehicle that stands up and transforms into a figure when it bumps into another object.

U.S. Pat. No. 7,794,300 to Moll et al. and U.S. Pat. No. 8,814,629 to Johnston et al. disclose various transforming toys.

U.S. Pat. No. 7,467,986 to Hanamoto et al. purports to disclose a transformer toy that transforms in an unpredictable manner.

U.S. Pat. No. 9,370,725 to Choi discloses a vehicle that, when it encounters a card that includes a magnet, both picks up the card and turns the card over, and transforms into a creature.

A toy displayed under the name Turning MeCard Dragon is a structure in the shape of a truck having a ramp for a toy vehicle to roll through the toy; when the vehicle rolls through the toy, the toy transforms into a dragon creature. The toy can be seen on a Youtube video posted at https://www.youtube.com/watch ?v=_Hs_K75hyXs, esp. at timestamp 4:35-7:33.

SUMMARY OF THE INVENTION

The present invention is of a toy structure that constitutes a transforming toy. As the toy structure is transforming from a first state or configuration to a second state or configuration it picks up a second toy such as a toy car and integrates that second toy into the transformer toy. As used herein, the transforming toy will sometimes be referred to simply as the "transformer." In a first exemplary embodiment, the transformer in its first or untransformed configuration is in the form of a stationary or non-mobile object such as a building having an opening for a toy vehicle to drive into or on. The transformer senses or detects the presence of the vehicle by any one of various sensing or detecting means such as a mechanical push switch, a magnetic sensor, an optical sensor, a radio frequency sensor such as an RFID chip and reader, or other possible sensors. When a toy vehicle enters the transformer through a drive-in opening within the transformer, the entry of the vehicle causes the transformer to transform into its second configuration in the form of an airplane. During the transformation and as part of the transformation, the transformer picks up the vehicle and places the vehicle into the transformer's command center or control center, such as the cockpit of the airplane in the case of an airplane transformer, or the head of a robot in the case of a robot transformer, such that the vehicle and/or its driver now appear to be in control of the transformer.

In its untransformed configuration, the transformer toy can have a stationary form such as the form of a building or other non-mobile structure. In the transformed configuration, the transformer toy can take on the form of a mobile structure such as a ground vehicle, a robot, an flying vehicle such as an airplane or helicopter, a space vehicle such as a space shuttle, or a water vehicle such as a boat or submarine.

More generally, therefore, the present invention is of a first toy that senses the presence or proximity of a second toy, and in response grasps the second toy and incorporates the second toy into the first toy or otherwise in association with the first toy such that the second toy occupies a command position for the first toy.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Figure 1:
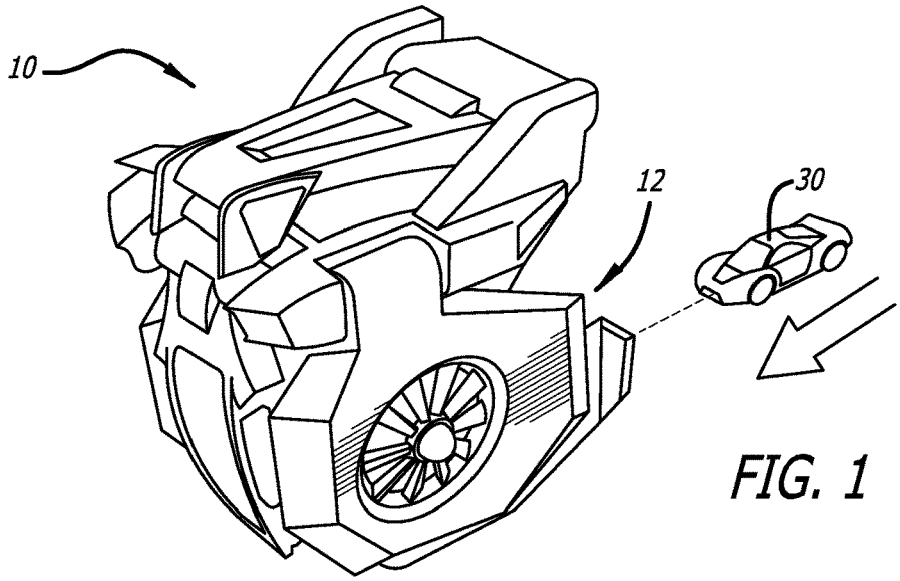
FIG. 1 is a an oblique front/left side view of a transformer toy according to a first embodiment and in its folded and untransformed configuration, and of a toy vehicle rolling toward the transformer toy.

FIG. 1 is a an oblique front/left side view of a transformer toy 10, or simply "transformer," according to a first embodiment and in its folded and untransformed configuration, and of a toy vehicle 30 rolling toward the transformer toy. Transformer 10 has an entrance 12 for toy car 30 to enter it. Entrance 12 constitutes a receiving section of transformer 10 for receiving toy car 30. Transformer 10 has been folded or compressed into this configuration by a user. The folding or compression processes stores energy into one or more bias mechanisms such as springs or elastic bands. Transformer 10 is held in this folded or untransformed configuration by one or more latches or similar latching mechanisms that hold transformer 10 in that configuration and prevent it from opening. In this embodiment, in its folded configuration transformer 10 does not have any visible command center.

Spring-loaded transforming mechanisms are well known in the field of toy design. Examples include: U.S. Pat. No. 5,310,378 to Shannon including FIG. 25 therein; U.S. Pat. No. 7,217,170 to Moll et al.; U.S. Pat. No. 7,785,168 to Yamada et al.; U.S. Pat. No. 8,814,629 to Johnston; and U.S. Pat. No. 9,370,725 to Choi. All of these references are incorporated by reference herein for their teachings of trigger mechanisms and spring-loaded or otherwise bias-driven transforming mechanisms.

Figure 2:
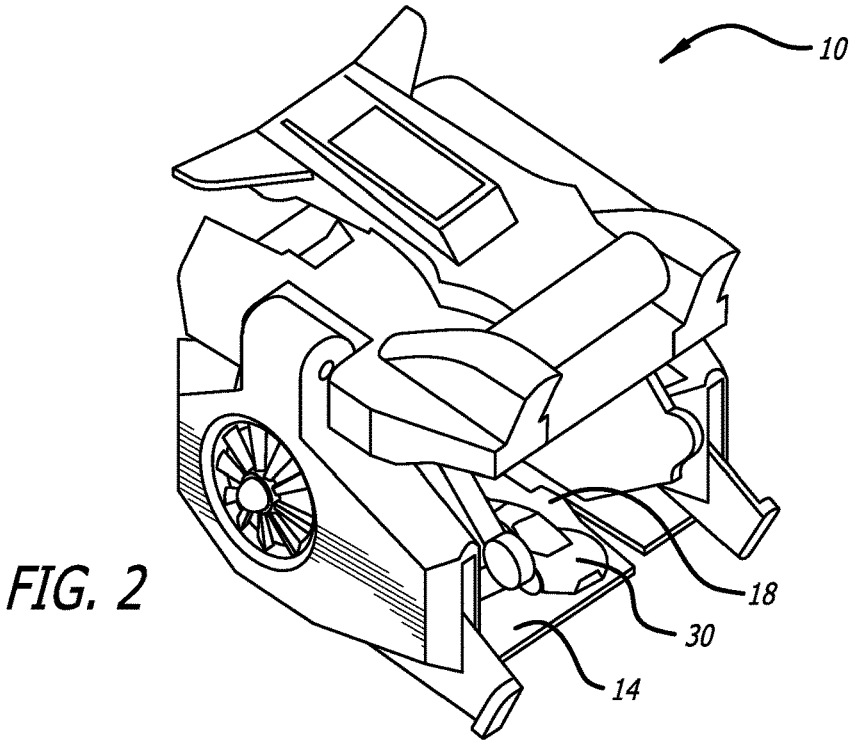
FIG. 2 is an oblique front/ride side view of the transformer toy of FIG. 1, after the toy vehicle as entered it.

FIG. 2 is an oblique front/ride side view of the transformer toy 10 of FIG. 1, after the toy car 30 as entered it. Toy car 30 now sits on vehicle support platform 14 at a forward section 16 thereof. Space 18 defines an internal space within transformer 10 for at least partially receiving toy car 30. A trigger or sensor (not shown) senses the presence of toy car 30 at least partially within internal space 18, triggering a transforming mechanism.

Figure 3:
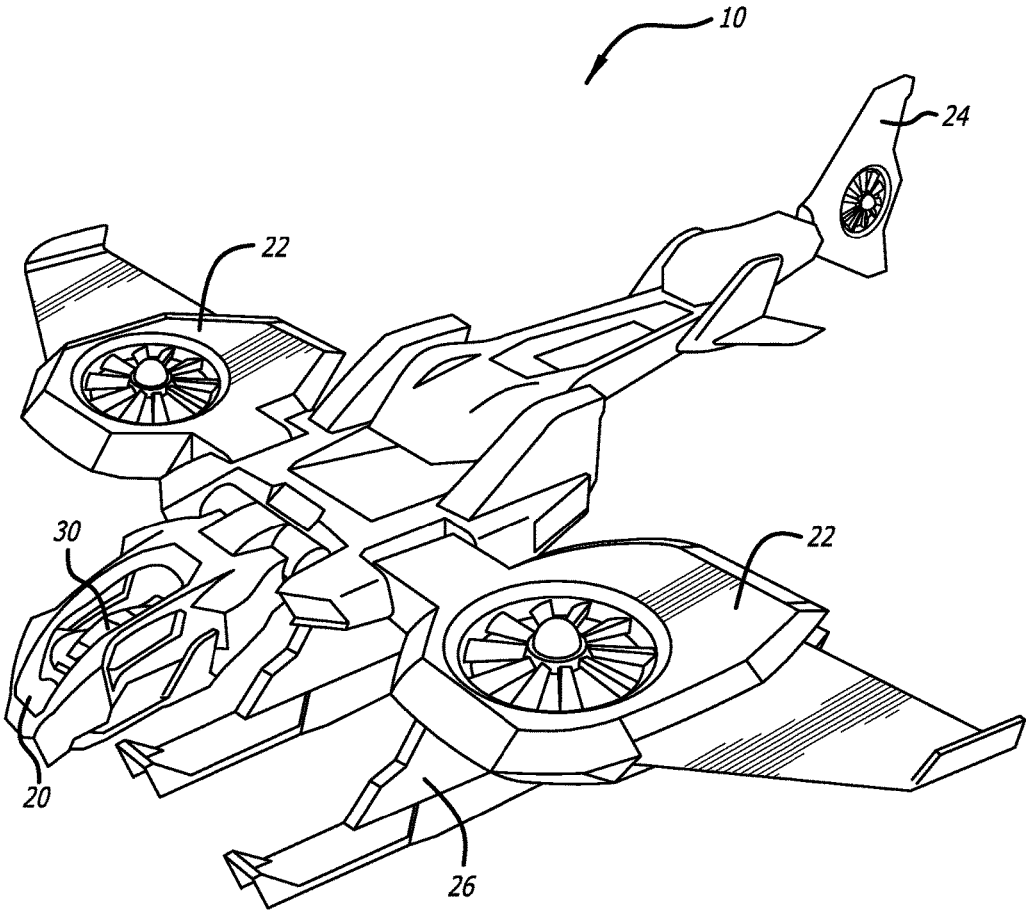
FIG. 3 is a view of the transformer toy of FIG. 1 from the same angle thereof, after the transformer toy has transformed into its unfolded and transformed configuration.

FIG. 3 is a view of the transformer 10 of FIG. 1 from the same angle thereof, after the toy 10 has transformed into its unfolded and transformed configuration. Entry of car 30 into entrance 12, or other sensing of the proximity of car 30 to transformer 10, has triggered the transforming mechanism to cause transformer 10 to achieve the transformed configuration shown. In this particular embodiment, transforming elements of transformer 10 include wings 22, a tail 24, and skid supports 26 that unfold or otherwise deploy into their respectively deployed configurations shown.

In the transformed configuration, platform 14 including toy car 30 thereon have now been picked up by transformer 10, and toy car 30 has been elevated above the ground surface 8 on which transformer 10 rests, and into a command center 20 position or structure within transformer 10. During the transformation platform 14 tilted forward to roll car 30 into command 20. In this embodiment command center 20 is the cockpit of a toy flying vehicle, which in this embodiment could be in the form of an airplane with hovering capabilities via the rotor blades embedded in wings 22, and/or a spacecraft. In transitioning from the untransformed configuration to the transformed configuration, transformer 10 has picked up car 30, moved it to the cockpit 20, and has stood up on legs or skid supports 26. Additionally, cockpit 20 has folded out from the body of transformer 20 to extend therefrom. Toy car 30 now appears to be in a command position within the transformed toy 10, may be held captive therein, and is at least partially visible to the child playing with the toy. The driver location of toy car 30 now appears to correspond to a command location of the transformer toy 10, and creates the appearance that a driver of the car is now flying an airplane from its cockpit. In this configuration transformer 10 is expanded relative to its untransformed configuration shown in FIG. 1.

Figure 4:
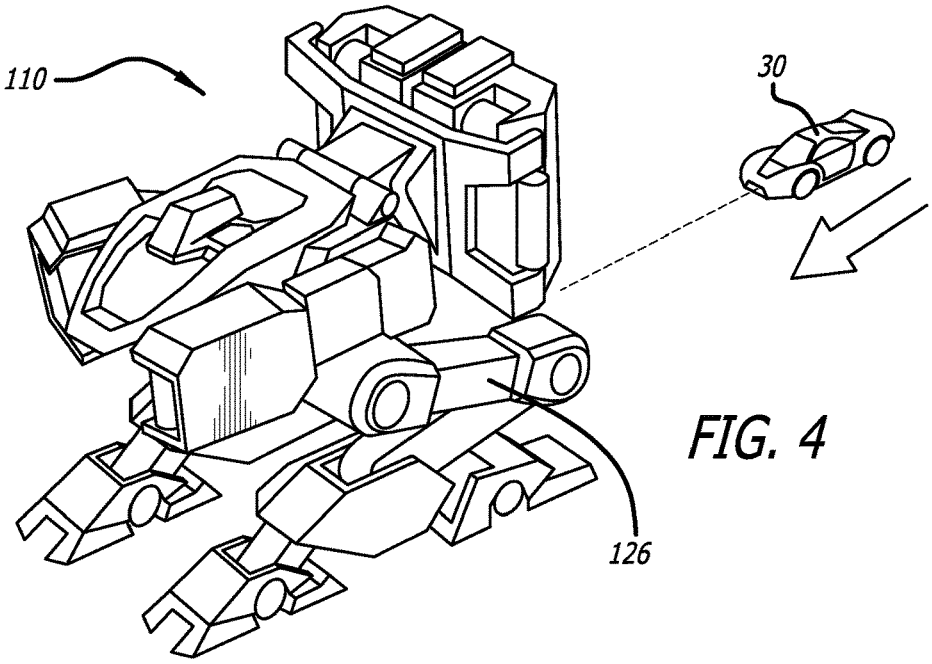
FIG. 4 is an oblique front/left side view of a transformer toy according to a second embodiment and in its folded and untransformed configuration, and of a toy vehicle rolling toward the transformer toy.

FIG. 4 is an oblique front/left side view of a transformer toy 110 according to a second embodiment and in its folded and untransformed configuration, and of a toy vehicle 30 rolling toward the transformer toy. In this embodiment and in this configuration, two legs 112 which support transformer toy 110 are mostly bent such that the transformer toy 110 is relatively low to the ground.

Figure 5:
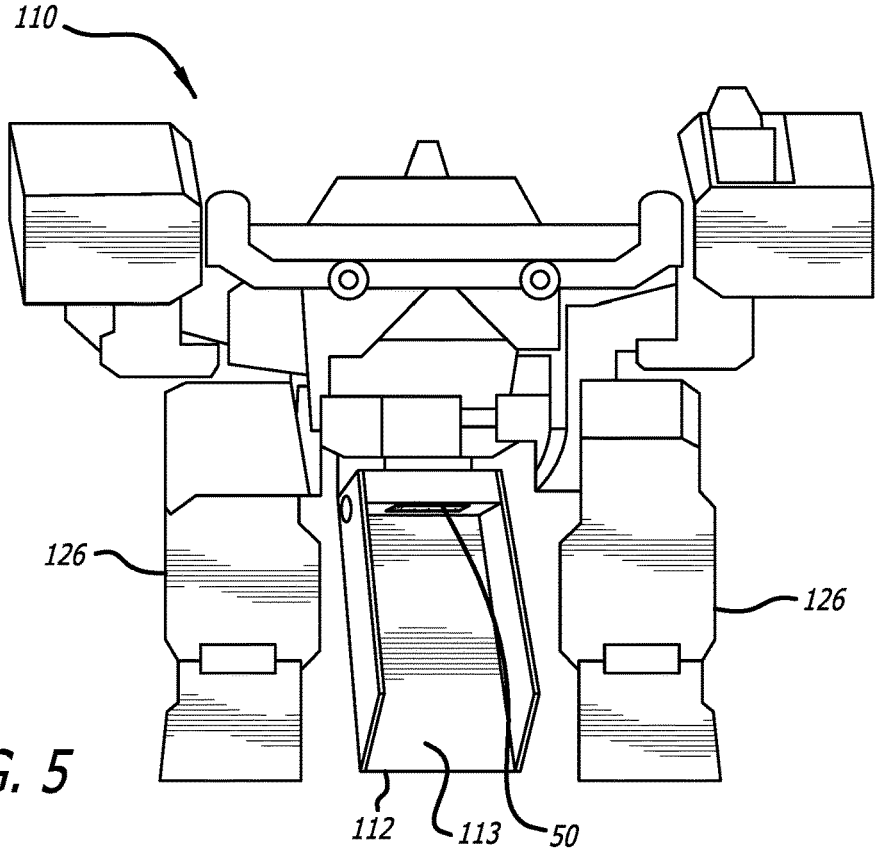
FIG. 5 is a rear elevation view of the transformer toy of FIG. 4.

FIG. 5 is a rear elevation view of the transformer toy 110 of FIG. 4. The toy includes an entrance 112 and a ramp 113 up which toy car 30 can roll. A sensor 50 senses when toy car 30 has rolled up ramp 113 and is present.

Figure 6:
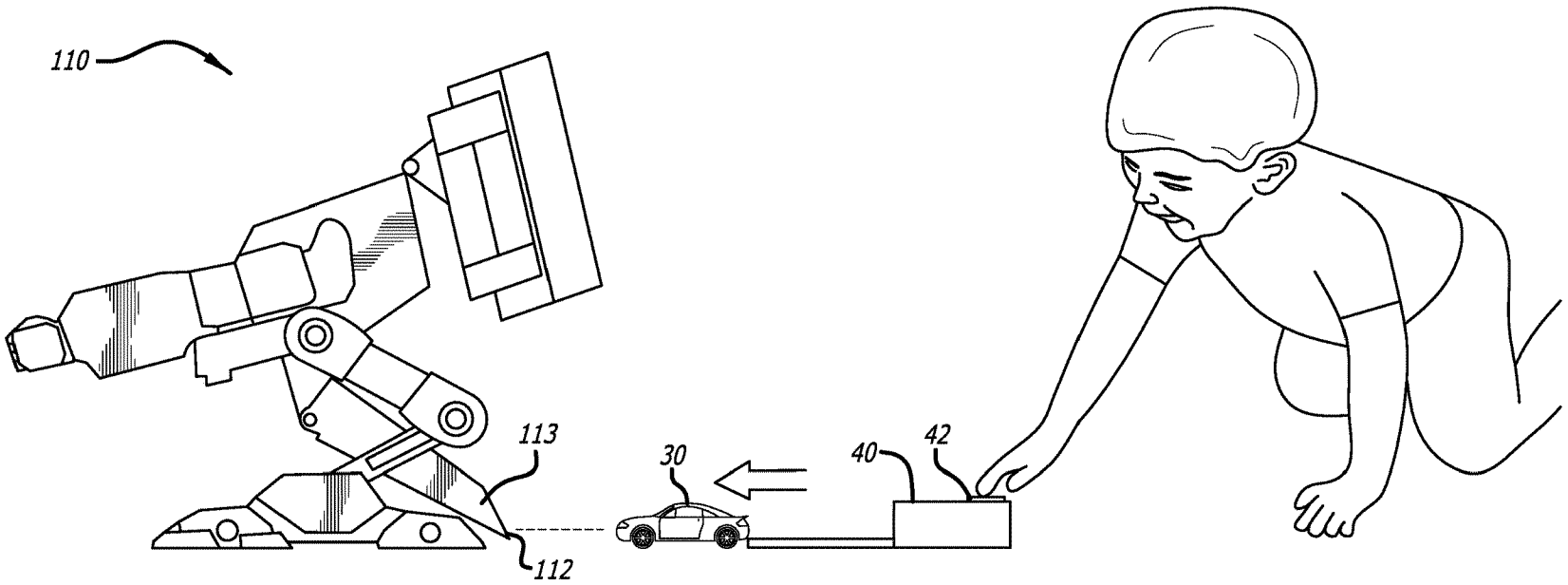
FIG. 6 is a left side elevation view of the transformer toy and the toy vehicle of FIG. 4, and a car launcher 40 that may be used with the transformer.

FIG. 6 is a left side elevation view of the transformer 110 and the toy vehicle 30 of FIG. 4, and a car launcher 40 that may be used with the transformer. Car launcher 40 is a toy by which a child can aim toy car 30 toward entrance 12 of transformer 110, and then press release button 42 to launch the toy car 30 forward. If the child has accurately aimed toy car 30, toy car 30 enters the entrance 112, and the toy car 30 activates sensor 50 and hence activates the trigger inside transformer 110 thus triggering the transformation. The presence of car launcher 40 thus adds another dimension of play. Toy car launchers are well know. Car launcher 40 could launch toy car 30 forward using the force of a compressed spring or stretched elastic. The child aims car launcher 40 towards transformer 110, then presses release button 42 to launch the car forward.

Figure 7:
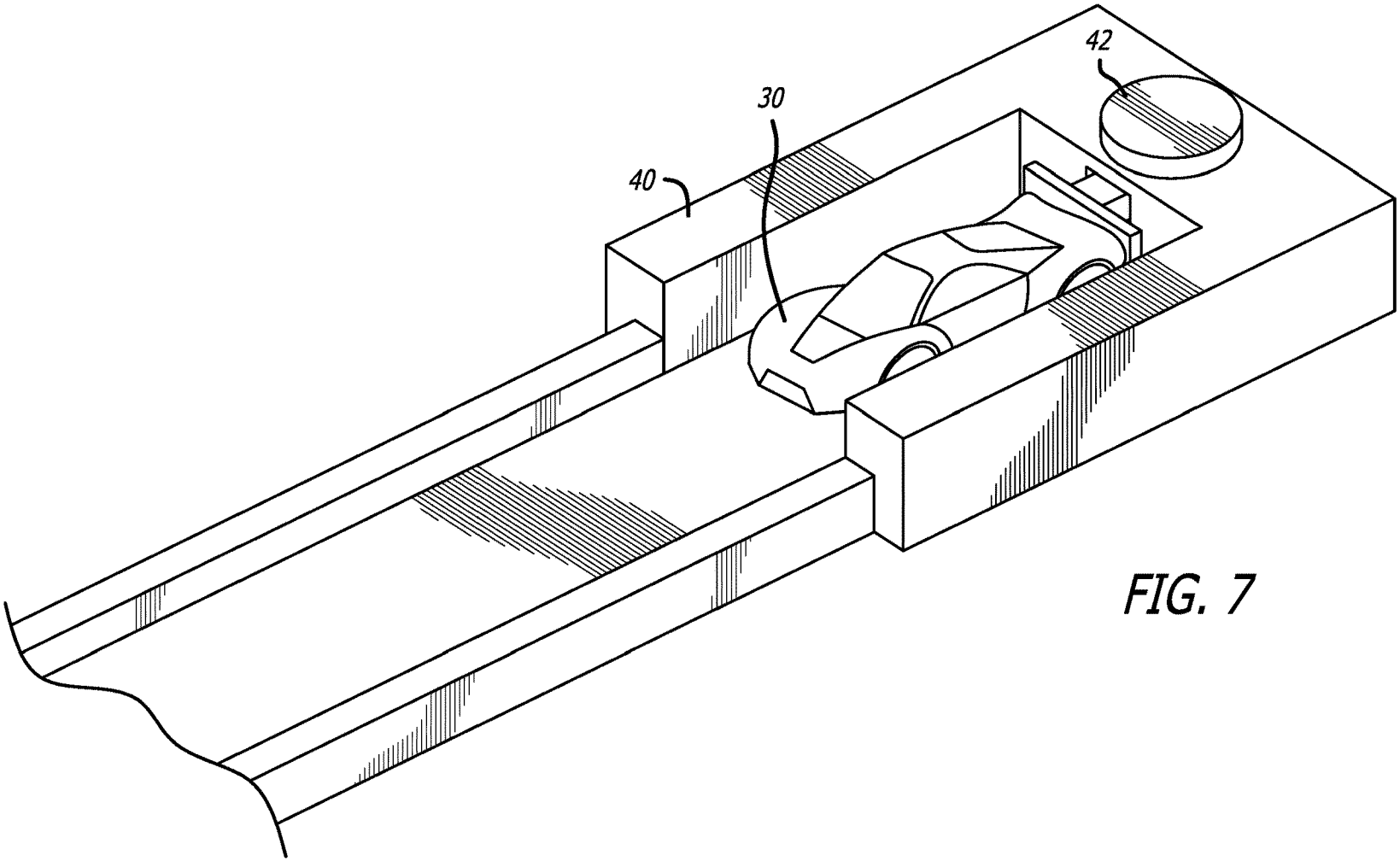
FIG. 7 is an oblique view of a toy car launcher that may be used with the transformer toy of FIG. 4.

FIG. 7 is an oblique view of a toy car launcher 40 that may be used with the transformer 110 of FIG. 4.

Figure 8:
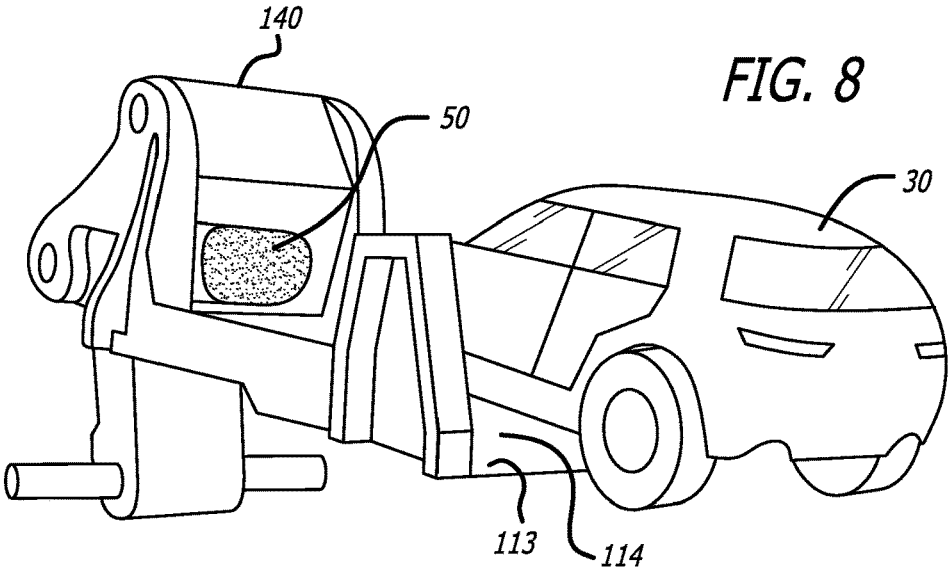
FIG. 8 is rear/left oblique view of the vehicle, vehicle entrance ramp, and sensor of the transformer toy of FIG. 4, with the those components isolated from the rest of the transformer.
Figure 9:
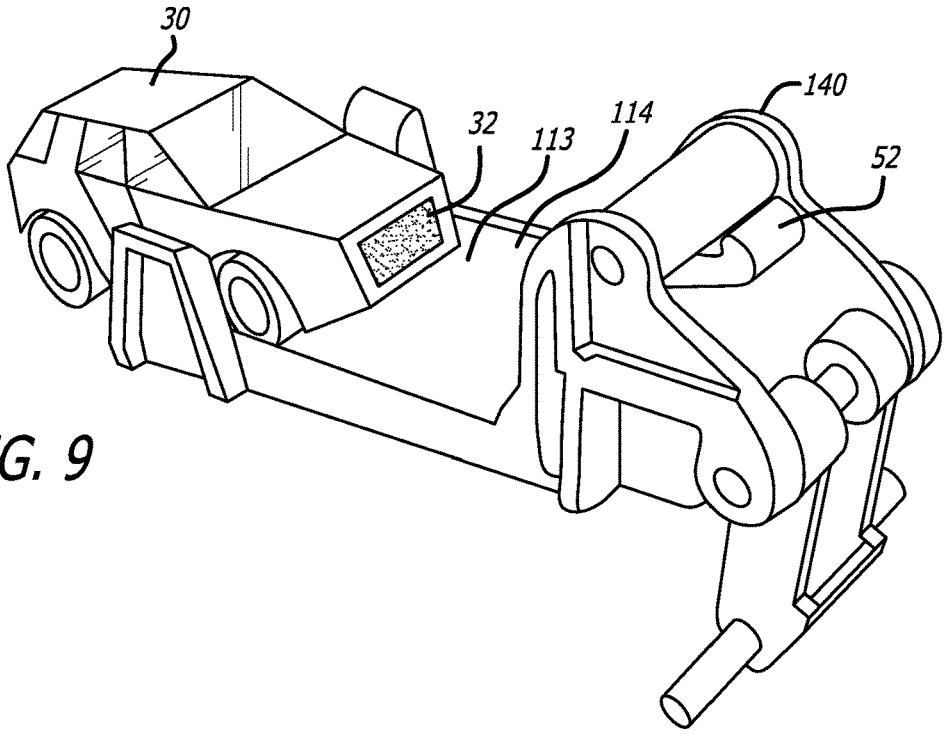
FIG. 9 is a front/left oblique view of the vehicle, vehicle entrance ramp, and trigger mechanism of FIG. 8.

FIG. 8 is rear/left oblique view of the vehicle 30, vehicle entrance ramp 113, support platform 114, and sensor 50 of the transformer toy of FIG. 4, with the those components isolated from the rest of the transformer toy 110 for clarity of illustration. FIG. 9 is a front/left oblique view of the vehicle 30, vehicle entrance ramp 113, support platform 114, and trigger mechanism 140 of FIG. 8.

Sensor 50 senses when toy car 30 is present, thus initiating the transforming process. Sensor or sensing means 50 can sense the presence of toy car 30 in any number of different ways. Sensor 50 could be a mechanical push-activated trigger that moves in response to toy car 30 bumping into the trigger and thus rotating it or moving it forward, thus releasing a latch 52 that holds the transformer in its untransformed configuration. Alternatively, sensor 50 could be a magnetic sensor, sensing the presence of a magnet 32 at the front end of toy car 30. As a further alternative, sensor 50 could be a weight sensor that senses the presence of the vehicle by its weight. Sensor 50 could be an acoustic sensor that senses the presence of the car by emitting acoustic waves such as ultrasonic waves and sensing the reflected return waves. Sensor 50 could be an optical sensor that optically senses the presence of toy car 30. Sensor 50 could even be a bar code reader, an RFID reader that senses an RFID chip embedded in the car, or a bar code or CQR code reader that not only senses the presence of the car but also detects what car it is and thus transforms in a way that is unique to that particular car. Many types of sensor means are possible. For some of those possible sensor means batter power or other electrical power will be required. Regardless of the type of sensor used, when sensor 50 senses that toy vehicle 30 is present, a trigger mechanism 140 causes transformer toy 110 to unfold into its unfolded, expanded, or transformed configuration. If springs or elastic chords are used in transformer 10, the energy stored in the compressed or stretched springs or the stretched elastic chords drive the transformation mechanism within transformer toy 10. Alternatively, transformer 110 could be battery-powered with a battery powering one or more servo motors that transform the toy into its transformed configuration, and back again later into the untransformed configuration.

Figure 10:
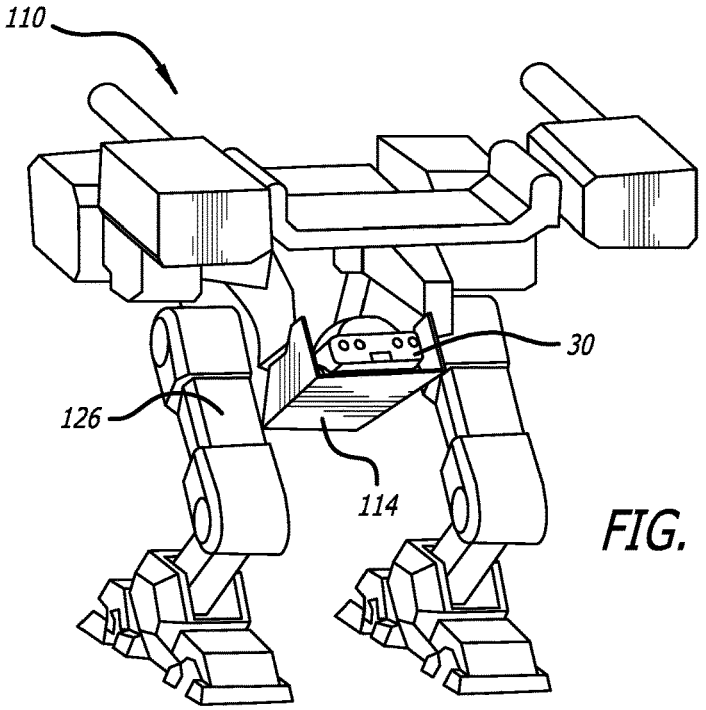
FIG. 10 is a rear/left oblique view of the transformer toy of FIG. 4 as the toy is transforming from its folded and untransformed configuration to its expanded and transformed configuration.

FIG. 10 is a rear/left oblique view of the transformer toy 110 of FIG. 4 as the toy is transforming from its folded and untransformed configuration to its expanded and transformed configuration. Platform 114 having toy car 30 thereon has been lifted up into the air, and has been tilted by the transforming action so that toy car 30 will now roll forward to a more forward position on platform 114 or, more generally, a more forward position within transformer toy 110. Legs 126 have also been partially straightened, i.e., are less bent than before the transforming action began. The legs 126 being partially straightened contributes to the lifting of platform 14 and toy car 30 thereon away from the ground surface and to a higher elevation off the ground surface.

Figure 11:
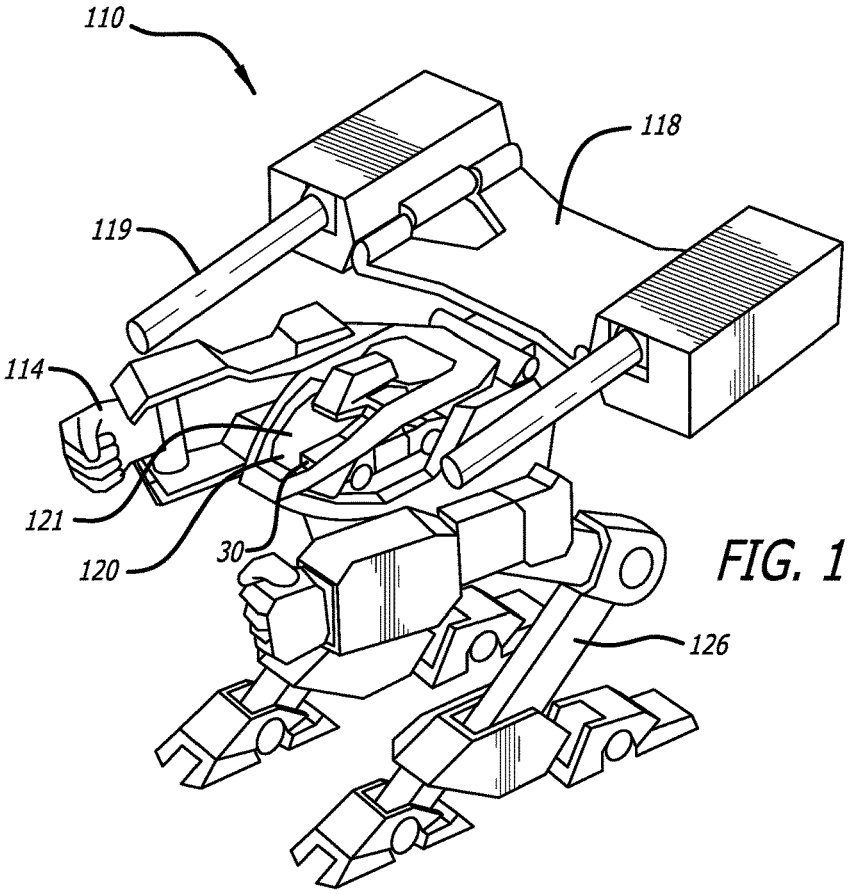
FIG. 11 is a front/left oblique view of the transformer toy of FIG. 4 after it has fully transformed.

FIG. 11 is a front/left oblique view of the transformer toy 110 of FIG. 1 after it has fully transformed. Transformer toy 110 is now a fully deployed humanoid robot, with extended deployed hands 114, and unfolded/deployed gun platform 118 including guns 119. Toy car 30 is now located in command center or cab 120 of transformer robot 110, at a location that generally corresponds to the head of the humanoid robot. Transformer toy 110 can include a transparent cover 12 that can take the form of windshield under which toy car 30 is located.

To begin folding the transformer toy 110 back into its folded or undeployed configuration, the child can simply reach into control center 120 and remove car 30. If windshield 121 is present, the windshield can be attached via a pivoting mechanism so that the child simply rotates the windshield 121 up in order to gain access to and remove car 30. The child then manually folds or pushes in the deployed sections such as guns 119, gun platform 118, hands 114, and legs 126, against the springs, elastic bands, or other biasing means that bias those sections toward their deployed configurations. Some sections may be designed to fold or retract independently of other sections, while other sections may be operatively connected together so that folding or retracting one section folds or retracts the other section at the same time.

Other embodiments and variations are possible. In its untransformed configuration the transformer toy could be a stationary object such as a building with a garage entrance, with the transformation being triggered when the toy vehicle enters the garage. In its untransformed configuration it could have a command center such as a central office within the building, or it could have no command center.

The transformer in its transformed configuration could be, as non-limiting examples, a creature such as a robot including both humanoid robots and non-humanoid robots, a flying vehicle such as an airplane, a land vehicle such as a tractor or a bulldozer or a tank, a water vehicle such as a boat or submarine, a space vehicle such as a spaceship, or a combination of such ships. In the transformed configuration, the toy vehicle that triggered the transformation could be picked up and positioned within the cockpit of the vehicle including the bridge of a space ship or the cab of a tractor or other machinery. If the transformed configuration is in the form of a creature such as an animal or robot, the toy vehicle could be picked up and placed within the head of the robot, or other command center for the robot which might not necessarily be within the head. For example, the command center could be located within the chest of a robot.

The second toy which is picked up by the transformer toy and integrated into it need not be a toy vehicle, and the transformation need not be triggered by the second toy completely or even partially entering the transformer toy. Rather, as but one example, the second toy could be a humanoid figure with a magnet in it, and the transformation could be triggered by a magnetic latch that is triggered by the proximity of the second toy including its embedded magnet. Thus, the humanoid figure could merely approach a particular location on transformer toy 110, whereupon the transformer toy picks up the humanoid form, transforms into its second configuration, and places the humanoid form within the command center such as the cockpit or driver's seat.

As yet another example, the transformer could transform into the form of a robotic dragon, with the second toy being a human figure that the transformer picks up and places on its back in a riding position as it transforms. The riding position on the back of the robotic dragon constitutes a command position of the dragon, just as the rider on the back of a horse occupies a command position associated with the horse. In a one aspect of the invention, therefore, as the transforming toy which defines a first toy transforms it picks up an object that defines a second toy and integrates it into or with the first toy with functional interaction, or at least imaginary and/or simulated functional interaction, between the two toys.

In another embodiment, the transformer need to not receive toy vehicle 30 within an internal space of the transformer toy in order to trigger the transformation. Rather, the transformer could sense that toy vehicle 30 is nearby, such as via a magnetic sensor, and reach out, grab the toy such as by a robotic arm, and incorporate the toy car as described otherwise in the preceding embodiments.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A transforming toy comprising:

a toy structure having a first configuration, the toy structure in the first configuration having an internal space for at least partially receiving a toy vehicle; and a trigger that is activated by the toy vehicle entering the internal space;

wherein:

activation of the trigger by the toy vehicle entering the internal space causes the toy structure to transform into a second configuration; and in the second configuration the toy structure has:

a command center; and the toy vehicle positioned within the command center.

2. The transforming toy of claim 1 wherein:

the command center is disposed at an elevation above a surface on which the toy structure rests; and the toy structure further comprises means for picking up the toy vehicle and elevating it to the command center as the toy structure transforms from the first configuration to the second configuration.

3. The transforming toy of claim 1 wherein the command center comprises a cockpit of a flying vehicle.

4. The transforming toy of claim 1 wherein the command center comprises a cab of a ground vehicle.

5. The transforming toy of claim 1 wherein, in the second configuration of the toy structure, the toy vehicle is positioned within the command center such that a driver location of the toy vehicle appears to correspond to a command location of the toy.

6. The transforming toy of claim 1 wherein, in the second configuration of the toy structure, the toy vehicle is positioned within the command center, is captive within the transformed toy, and is at least partially visible to a child playing with the transforming toy.

7. The transforming toy of claim 1 wherein the toy structure does not have a command center in its first configuration.

8. The transforming toy of claim 1 wherein the trigger comprises a mechanical switch that is activated by the toy vehicle pressing against the switch.

9. The transforming toy of claim 1 wherein the trigger comprises a magnetic switch, the toy vehicle includes a magnet, and the magnetic switch is triggered by the magnet within the vehicle coming into proximity with the magnetic switch.

10. In combination, the transforming toy of claim 1 and a toy vehicle launcher by which a child can aim the launcher at the transforming toy and launch the toy vehicle toward the internal space.

11. A transforming toy defining a first toy, the transforming toy comprising:

a structure having a first configuration and a second configuration, the structure including a latch that holds the structure in the first configuration; and means for releasing the latch;

wherein:

the latch being released causes the structure to transform into its second configuration; and as the structure transforms into its second configuration, the structure picks up a second toy and integrates the second toy into the first toy.

12. The transforming toy of claim 11 wherein the means for releasing the latch comprises at least one of a mechanical trigger, a magnetic trigger, an optical trigger, an acoustic trigger, and a radio frequency trigger.

13. The transforming toy of claim 11 wherein the first configuration of the transforming toy is in the form of a stationary object.

14. The transforming toy of claim 13 wherein the stationary object has an entrance for a toy vehicle to drive into, and the means for releasing the latch comprises a sensor for sensing when the second toy has entered the entrance.

15. The transforming toy of claim 13 wherein the stationary object is a building.

16. The transforming toy of claim 13 wherein the second configuration is in the form of a vehicle for at least one of land travel, air travel, water travel, and space travel, and in the second configuration of the first toy the second toy is positioned at a driver's position within the vehicle.

17. The transforming toy of claim 11 wherein, in the second configuration the first toy is in the form of a robot and the second toy is positioned within a command center of the robot.

18. The transforming toy of claim 17 wherein the robot has a head, and the command center is within the head.

19. A transforming toy comprising:

a toy structure having a first configuration, the toy structure in the first configuration having a receiving section for receiving a toy vehicle;

a detector for detecting a presence of the toy vehicle at the receiving section; and an actuator for transforming the transforming toy from said first configuration to a second configuration in response to said detector detecting the presence of the toy vehicle at the receiving section;

wherein:

in its second configuration, the transforming toy is expanded relative to its first configuration;

in its second configuration, the transforming toy includes a command center; and as the transforming toy transforms from its first configuration into its second configuration, the transforming toy moves the toy vehicle to a position within the command center.

20. The transforming toy of claim 19 wherein:

the first configuration is in the form of a non-mobile object; and the second configuration is in the form of a mobile vehicle.

21. In combination, the transforming toy of claim 19 and a toy vehicle launcher by which a child can aim the launcher at the transforming toy and launch the toy vehicle toward the receiving section.

* * * * *